US008879776B2

(12) United States Patent
Takewa et al.

(10) Patent No.: US 8,879,776 B2
(45) Date of Patent: Nov. 4, 2014

(54) SPEAKER AND ELECTRONIC DEVICE USING THE SPEAKER

(75) Inventors: Hiroyuki Takewa, Osaka (JP); Shinya Kagawa, Mie (JP)

(73) Assignee: Panasonic Corporation, Osaka (JP)

( * ) Notice: Subject to any disclaimer, the term of this patent is extended or adjusted under 35 U.S.C. 154(b) by 0 days.

(21) Appl. No.: 13/643,456

(22) PCT Filed: Feb. 23, 2012

(86) PCT No.: PCT/JP2012/001219

§ 371 (c)(1),
(2), (4) Date: Oct. 25, 2012

(87) PCT Pub. No.: WO2012/120806

PCT Pub. Date: Sep. 13, 2012

(65) Prior Publication Data

US 2013/0051603 A1 Feb. 28, 2013

(30) Foreign Application Priority Data

Mar. 4, 2011 (JP) ..... 2011-048352

(51) Int. Cl.

| | |
|---|---|
| ***H04R 9/06*** | (2006.01) |
| ***H04R 9/04*** | (2006.01) |
| ***H04R 7/12*** | (2006.01) |

(52) U.S. Cl.

CPC .. *H04R 7/12* (2013.01); *H04R 9/06* (2013.01); *H04R 9/04* (2013.01)

USPC ..... 381/398; 381/430; 381/423; 381/424; 181/157; 181/160

(58) Field of Classification Search

CPC ..... H04R 7/00; H04R 7/02; H04R 7/12; H04R 11/02

USPC ..... 381/398, 423, 430, 80, 424; 181/157, 181/158, 160, 161

See application file for complete search history.

(56) References Cited

U.S. PATENT DOCUMENTS

| | | | | |
|---|---|---|---|---|
| 4,782,471 | A * | 11/1988 | Klein | 367/168 |
| 5,664,024 | A * | 9/1997 | Furuta et al. | 381/412 |
| 5,701,358 | A * | 12/1997 | Larsen et al. | 381/423 |
| 7,961,902 | B2 * | 6/2011 | Horigome et al. | 381/421 |
| 2008/0063235 | A1 * | 3/2008 | Takewa | 381/412 |

FOREIGN PATENT DOCUMENTS

| | | |
|---|---|---|
| JP | 3-035697 | 2/1991 |
| JP | 8-265895 | 10/1996 |
| JP | 9-200891 | 7/1997 |

(Continued)

OTHER PUBLICATIONS

International Search Report issued Apr. 3, 2012 in International (PCT) Application No. PCT/JP2012/001219.

*Primary Examiner* — Davetta W Goins
*Assistant Examiner* — Oyesola C Ojo
(74) *Attorney, Agent, or Firm* — Wenderoth, Lind & Ponack, L.L.P.

(57) ABSTRACT

A speaker (200) includes a cylindrical diaphragm (201) which has closed ends, an edge (202) which supports the diaphragm (201) in a manner which allows the diaphragm to vibrate, a voice coil bobbin (203) around which a voice coil (204) is wound and which is connected to the diaphragm (201), and a magnetic circuit for driving the voice coil (204).

15 Claims, 21 Drawing Sheets

(56) References Cited

FOREIGN PATENT DOCUMENTS

| | | |
|---|---|---|
| JP | 2003-023695 | 1/2003 |
| JP | 2003-304591 | 10/2003 |
| JP | 2006-222989 | 8/2006 |
| JP | 2008-109541 | 5/2008 |

* cited by examiner

FIG. 3

| Sectional shape | Hollow semicircle | Hollow circle |
|---|---|---|
| Geometrical moment of inertia [$mm^4$] | 0.6 | 4.3 |
| Radius of gyration [mm] | 0.7 | 1.3 |
| Sectional area [$mm^2$] | 2.5 | 4.9 |

| | | Primary mode | Secondary mode | Tertiary mode |
|---|---|---|---|---|
| Hollow semicircle | Resonance frequency (theoretical value) | 610 Hz | 3298 Hz | 8145 Hz |
| | Resonance frequency (FEM value) | 624 Hz | 3295 Hz | 7143 Hz |
| | Vibration mode |  |  |  |
| Hollow circle | Resonance frequency (theoretical value) | 1154 Hz | 6239 Hz | 15407 Hz |
| | Resonance frequency (FEM value) | 1255 Hz | 6395 Hz | 14336 Hz |
| | Vibration mode |  |  |  |

SPEAKER AND ELECTRONIC DEVICE USING THE SPEAKER

TECHNICAL FIELD

The present invention relates to speakers and electronic devices using the same, and particularly to a speaker having a thin structure.

BACKGROUND ART

In recent years, along with the popularization of so-called hi-definition televisions, wide-screen televisions, and others, horizontally-long displays have been becoming common as television displays. Moreover, thinner systems are desired as television sets as a whole.

A speaker unit (hereinafter referred to as a speaker) used in a flat-screen television is required to have reduced width and thickness because of thinner design of a television and a so-called slim-type display which has thinner housing around the display. At the same time, audio with higher quality is also required along with increased quality of the display.

The following describes a conventional speaker 10 having a track-shaped long structure used in a flat-screen television with reference to FIGS. 15A to 15C.

FIG. 15A shows a top view of the conventional speaker 10 having the track-shaped long structure, FIG. 15B shows a sectional view seen from A-A' in FIG. 15A, and FIG. 15C shows a sectional view seen from B-B' in FIG. 15A.

In FIGS. 15A to 15C, the conventional speaker 10 having the track-shaped long structure includes a diaphragm 1, an edge 2, a voice coil bobbin 3, a voice coil 4, a plate 5, a magnet 6, a yoke 7, and a flame 8.

The outer periphery of the diaphragm 1 is adhered to the inner periphery of the edge 2. The shape of the diaphragm 1 is as follows: the planar shape viewed from the vibrating direction has a long side and a short side, the sectional shape in the short direction is hollow circular, and the both ends in the long direction is ¼ spherical.

The outer periphery of the edge 2 is fixed to the frame 8.

The voice coil bobbin 3 is adhered to the outer periphery of the diaphragm 1 and applies power on the diaphragm 1.

The voice coil 4 is held by the voice coil bobbin 3 in such a manner that the voice coil 4 is positioned in a magnetic gap G of a magnetic circuit.

The plate 5, the magnet 6, and the yoke 7 constitute an internal magnet type magnetic circuit. The internal magnet type magnetic circuit generates magnetic flux in the magnetic gap G formed between internal walls of the plate 5 and the yoke 7. As for the configuration of the magnetic circuit, the plate 5 is fixed on the top surface of the magnet 6, and the magnet 6 is fixed on the inner bottom surface of the yoke 7. Moreover, the plate 5, the magnet 6, and the yoke 7 are positioned such that the respective long directions match the long direction of the diaphragm 1, and the central axes approximately match.

The frame 8 is fixed at the bottom side of the end of the edge 2. Moreover, the frame 8 is also fixed on the bottom surface of the above magnetic circuit.

The following describes operations of the conventional speaker 10 having the track-shaped long structure as described above.

When a current is supplied to the voice coil 4, the supplied current and a magnetic field generated in the magnetic gap G generate driving force in the voice coil 4. The generated driving force is transmitted to the diaphragm 1 through the voice coil bobbin 3. The generated driving force causes the diaphragm 1, the voice coil bobbin 3, and the voice coil 4 to perform the same vibratory movement. Then, the vibration of the diaphragm 1 radiates sound to space.

CITATION LIST

Patent Literature

[PTL 1] Japanese Unexamined Patent Application Publication No. 8-265895

SUMMARY OF INVENTION

Technical Problem

However, the above-described speaker having the conventional structure can have the following problems.

In the case of a long and thin diaphragm the planar shape of the vibrating surface of which viewed from the vibrating direction has a long side and a short side, and the ratio of the lengths in the long direction to the short direction of which is large, an eigen vibration mode is generated that is determined by the length in the long direction. As a result, peak/dip may occur in a voice band important to sound pressure frequency characteristics, thereby causing deterioration in sound quality. In order to suppress the influence on the sound pressure frequency characteristics caused by the eigen vibration mode, the diaphragm needs to be driven entirely in the long direction. The conventional speaker 10 uses the voice coil 4 and the voice coil bobbin 3 the planer shapes of which viewed from the vibrating direction are long and thin track-shapes to drive the entire diaphragm in the long direction.

In this regard, we examined a structure in which a small voice coil is used. Here, the ratio of the lengths of the voice coil in the long direction to the short direction is approximately 2 to 1.

However, in the case where the above-described voice coil is used, all the vibration mode of the diaphragm cannot be suppressed. Therefore, an approach is needed to decrease the number of vibration modes that affects the voice band specifically important to the sound pressure frequency characteristics as much as possible, and to suppress only the remaining vibration mode.

In view of the above, the present invention has as an object to raise frequencies in the vibration mode and suppress resonance, and aims at expansion in bandwidth.

Solution to Problem

A speaker according to an embodiment of the present invention includes: a diaphragm which is cylindrical and has closed ends; an edge which supports the diaphragm in a manner which allows the diaphragm to vibrate; a voice coil bobbin around which a voice coil is wound and which is connected to the diaphragm; and a magnetic circuit for driving the voice coil.

For example, the diaphragm may have a circular sectional shape in a short direction.

Moreover, it may be that the diaphragm is formed to include a first diaphragm and a second diaphragm each of which includes: a circular arc portion having a semicircular sectional shape in the short direction; and a flange protruding outward from both ends of the circular arc portion in a radial direction, and the flange of the first diaphragm and the flange of the second diaphragm are connected to each other.

Furthermore, both ends of the diaphragm may have a semi-spherical shape which bulges outward in a long direction.

For example, the voice coil bobbin may include two voice coil bobbins, and the two voice coil bobbins may be attached at node positions of a primary resonance mode in the diaphragm symmetrically with respect to the center of the diaphragm in the long direction.

Specifically, given that a first end of the diaphragm in the long direction is 0 and a second end is 1, it may be that an attachment position of a first voice coil bobbin of the two voice coil bobbins includes a position 0.224, and an attachment position of a second voice coil bobbin of the two voice coil bobbins includes a position 0.776.

For another example, the voice coil bobbin may include four voice coil bobbins, and the four voice coil bobbins may be attached at node positions of a primary resonance mode and a secondary resonance mode in the diaphragm symmetrically with respect to the center of the diaphragm in the long direction.

Specifically, given that a first end of the diaphragm in the long direction is 0 and a second end is 1, it may be that an attachment position of a first voice coil bobbin of the four voice coil bobbins includes a position 0.113, an attachment position of a second voice coil bobbin of the four voice coil bobbins includes a position 0.37775, an attachment position of a third voice coil bobbin of the four voice coil bobbins includes a position 0.62225, and an attachment position of a fourth voice coil bobbin of the four voice coil bobbins includes a position 0.877.

For another example, the voice coil bobbin may include two voice coil bobbins, and each of the two voice coil bobbins may be attached between a corresponding one of node positions of a primary resonance mode and a corresponding one of node positions of a secondary resonance mode in the diaphragm, the two voice coil bobbins being symmetric with respect to the center of the diaphragm in the long direction.

Specifically, given that a first end of the diaphragm in the lone direction is 0 and a second end is 1, it may be that an attachment position of a first voice coil bobbin of the two voice coil bobbins includes a position 0.332, and an attachment position of a second voice coil bobbin of the two voice coil bobbins includes a position 0.668.

Furthermore, it may be that the diaphragm has a through hole at an attachment position of the voice coil bobbin, and the voice coil bobbin is attached to the diaphragm by inserting the voice coil bobbin through the through hole.

An electronic device according to an embodiment of the present invention includes a speaker. The speaker includes; a diaphragm which is cylindrical and has closed ends; an edge which supports the diaphragm in a manner which allows the diaphragm to vibrate; a voice coil bobbin around which a voice coil is wound and which is connected to the diaphragm; and a magnetic circuit for driving the voice coil.

Advantageous Effects of Invention

According to the present invention, employment of the cylindrical diaphragm which has closed ends can improve the rigidness of the diaphragm in the long direction. As a result, an advantage is obtained that frequencies in the vibration mode in the long direction can be raised.

BRIEF DESCRIPTION OF DRAWINGS

FIG. 3 is a table showing calculated values of a geometrical moment of inertia, a radius of gyration, and a sectional area in the cases where the sectional shape is hollow circular and hollow semicircular.

DESCRIPTION OF EMBODIMENTS

As a prior art document relevant to the invention of the present application, for example, Patent Literature (PTL) 1 is known.

However, use of a voice coil and a voice coil bobbin having a long and thin structure has the following problems. One problem is that it is difficult to ensure linear precision of a linear portion in the long direction in manufacturing long and thin voice coils that fit the size of long and thin speakers (for example, width 10 mm×thickness 13 mm×length 100 mm) for the current flat-screen televisions.

Second problem is that the linear portion of the voice coil bobbin resonates in some particular frequencies (resonance frequencies) and thus vibrates in the direction diagonal to the vibrating direction of the diaphragm (in the direction of magnetic flux in a magnetic gap of a magnetic circuit which drives the voice coil bobbin). As the linear portion becomes longer, the resonance frequencies are lowered and resonance amplitude increases. In order to solve the above two problems, in PTL 1, a thin plate connector is attached, inside the voice coil bobbin, across the surfaces facing each other with respect to the direction of the short diameter of the diaphragm in parallel with the vibrating direction and perpendicular to the surfaces.

The third problem is that a large magnet is required for driving the long and thin voice coil. The length of the magnet needs to correspond to the length of the voice coil in the long direction. Moreover, a smaller speaker requires an external magnet type magnetic circuit and use of a neodymium magnet instead of a ferrite magnet, for the purpose of obtaining sufficient magnetic flux. As a result, material costs for the magnets increase.

In this regard, with reference to Embodiments 1 to 4 of the present invention, the following describes in detail the structure of a speaker which effectively prevents, using an approach different from the above PTL 1, peak/dip from occurring in the voice band important to the sound pressure frequency characteristics.

It should be noted that the embodiments described below are each merely an exemplary embodiment of the present invention. The numerical values, shapes, materials, structural elements, disposition or a form of connection between the structural elements, steps, the order of the steps, and others in the following embodiments are merely illustrative, and are not intended to limit the present invention. The present invention is limited only by the scope of Claims. Thus, among the structural elements in the following embodiments, structural elements not recited in any one of the independent claims defining the most generic part of the present invention are not necessarily required to overcome conventional problems, but will be described as structural elements for preferable embodiments.

Embodiment 1

The following describes a diaphragm used in a speaker according to Embodiment 1 of the present invention with reference to the drawings.

Figure 1A:
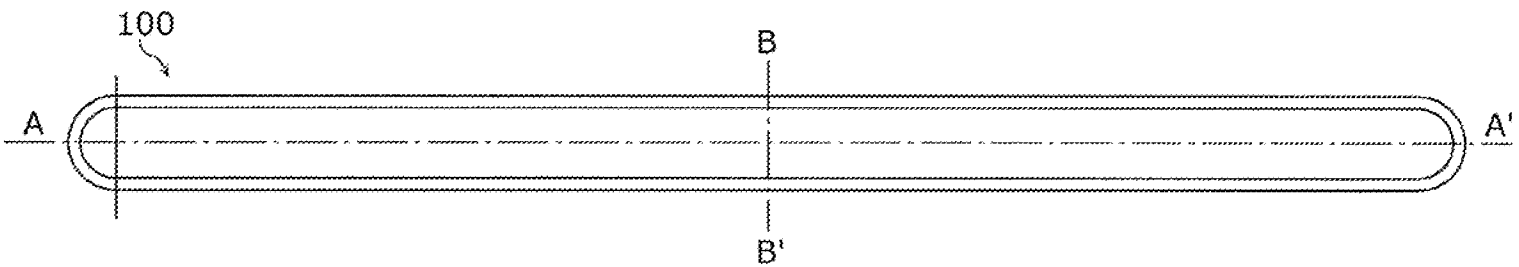
FIG. 1A is a top view of a diaphragm according to Embodiment 1.
Figure 1B:
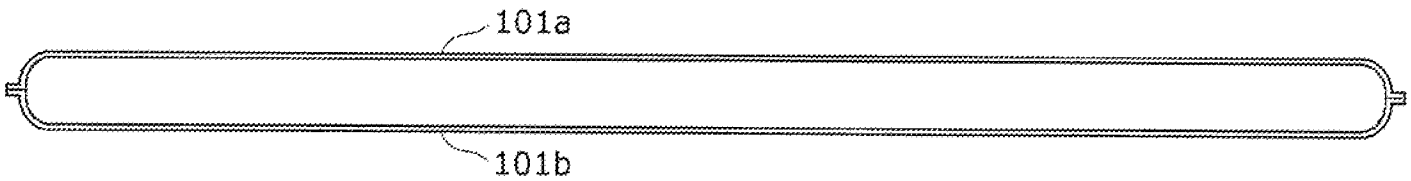
FIG. 1B is a sectional view of the diaphragm according to Embodiment 1 seen from A-A'.
Figure 1C:
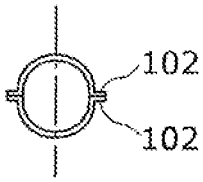
FIG. 1C is a sectional view of the diaphragm according to Embodiment 1 seen from B-B'.

FIG. 1A shows a top view of the diaphragm used in the speaker according to Embodiment 1, FIG. 1B shows a sectional view seen from A-A' in FIG. 1A, and FIG. 1C shows a sectional view seen from B-B' in FIG. 1A.

In FIGS. 1A to 1C, the structure of a diaphragm 100 is as follows: the planar shape viewed from the vibrating direction has a long side and a short side, the sectional shape in the short direction is hollow circular, and the both ends in the long direction is hollow semispherical. In other words, the diaphragm 100 has a cylindrical shape with the bottom and has closed ends. Moreover, the sectional shape in the short direction of the diaphragm 100 is a perfect circle. Furthermore, the both ends of the diaphragm 100 have a semicircular shape which bulges outward in the long direction. Material of the diaphragm 100 is preferably light and suitable for thinner structure. For example, paper and polymeric films are most suitable, but lightweight highly rigid metallic foil such as aluminum and titanium may also be used.

The diaphragm 100 is made up of a first diaphragm 101*a* and a second diaphragm 101*b* bonded together each of which has a diaphragm-bonding portion (a flange) 102 at the ends of the portion the sectional shape in the short direction of which is semicircular, and the planer shape of the diaphragms 101*a* and 101*b* viewed from the top is long and thin truck-shape.

In other words, each of the first diaphragm 101*a* and the second diaphragm 101*b* has a circular arc portion the sectional shape in the short direction of which is semicircular (a portion the sectional shape in the short direction of which is semicircular) and a flange protruding out from the both ends of the circular arc portion in a radial direction. The diaphragm 100 is formed in such a manner that the first diaphragm 101*a* and the second diaphragm 101*b* are connected to each other by connecting the respective flanges.

With respect to the diaphragm 100 having the structure as described above, the following describes effects of modifying the sectional shape in the short direction from the conventional hollow semicircular to hollow circular in terms of theory and a simulation. First, a description is given in terms of theory.

The outer periphery of the diaphragm 100 is usually held by edges in such a manner that the diaphragm 100 is hung in the air. As a result, the diaphragm 100 can be regarded as a bar both ends of which are approximately free. Therefore, a theory of vibration mode of the bar both ends of which are free can be applied in reviewing resonance frequencies in the vibration mode and a change in rigidity according to sectional shapes. The following describes the theory of the vibration mode of the bar both ends of which are free. Expression 1 shows expression for resonance frequencies in the vibration mode of the bar both ends of which are free. In Expression 1, l denotes the length of the bar, ρ denotes density, Q denotes Young's modulus of the material, and K denotes a radius of gyration.

[Math 1]

$$f_1 \propto \frac{1.133\pi}{l^2}\sqrt{\frac{QK^2}{\rho}} \text{ (fundamental frequency)}, \qquad \text{(Expression 1)}$$

$$f_n \propto \frac{\pi}{8l^2}\sqrt{\frac{QK^2}{\rho}}(2n+1)^2 \text{ (where } n \geq 2)$$

In Expression 1, the radius of gyration K varies depending on the sectional shapes.

Figure 2A:
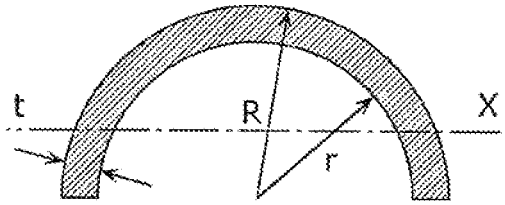
FIG. 2A is a diagram showing a hollow semicircular sectional-shape model for calculating a radius of gyration.
Figure 2B:
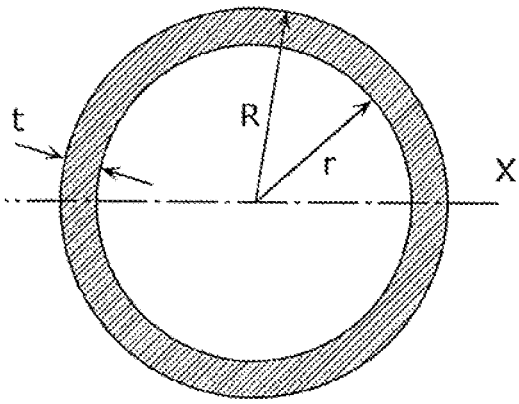
FIG. 2B is a diagram a hollow circular sectional-shape model for calculating a radius of gyration.

FIG. 2A shows the hollow semicircular sectional shape and FIG. 2B shows the hollow circular sectional shape. The following describes the radius of gyration in each sectional shape using FIGS. 2A and 2B.

First, the hollow semicircular sectional shape in FIG. 2A will be described.

According to the theorem of geometrical moment of inertia, the geometrical moment of inertia of hollow sectional shapes such as a tube and a tunnel can be determined by subtracting the geometrical moment of inertia of the hollow shape from the geometrical moment of inertia of the outer shape. Here, the positions of the center of the outer shape and the center of the inner shape are different with respect to a reference axis for determining the geometrical moment of inertia. However, in the case where the sectional shape of the diaphragm is hollow semicircular according to this embodiment, since the diaphragm is very thin, the radius of the outer semicircle and the radius of the inner semicircle are considered to be approximately the same.

Thus, the geometrical moment of inertia of the hollow semicircle is a difference of the geometrical moments of inertia between the outer semicircle and the inner semicircle. Expression 2 shows the geometrical moment of inertia of a semicircle that is not hollow, Expression 3 shows the geometrical moment of inertia of the hollow semicircular sectional shape, and Expression 4 shows the area of the hollow semicircular sectional shape. In Expression 2, rsemi denotes the radius of the semicircle that is not hollow, and in Expressions 3 and 4, R denotes the radius of the outer semicircle and r denotes the radius of the inner semicircle.

[Math 2]

$$\left(\frac{\pi}{8}-\frac{8}{9\pi}\right)r_{semi}^{4} \quad \text{(Expression 2)}$$

[Math 3]

$$\left(\frac{\pi}{8}-\frac{8}{9\pi}\right)(R^4-r^4) \quad \text{(Expression 3)}$$

[Math 4]

$$\frac{\pi}{2}(R^2-r^2) \quad \text{(Expression 4)}$$

Since a radius of gyration is the square root of the quotient of a geometrical moment of inertia and a sectional area, the radius of gyration of the hollow semicircular sectional shape is expressed as Expression 5.

[Math 5]

$$\sqrt{\left(\frac{1}{4}-\frac{16}{9\pi^2}\right)\left(\frac{R^4-r^4}{R^2-r^2}\right)} \quad \text{(Expression 5)}$$

In the case of the hollow circle in FIG. 2B, the geometrical moment of inertia and the radius of gyration can be determined by the same method as above, too. Therefore, only expressions are shown and the description will be omitted. Expression 6 shows the geometrical moment of inertia of the hollow circular sectional shape, Expression 7 shows its radius of gyration, and Expression 8 shows its sectional area.

[Math 6]

$$\frac{\pi}{4}(R^4-r^4) \quad \text{(Expression 6)}$$

[Math 7]

$$\frac{\sqrt{R^2+r^2}}{2} \quad \text{(Expression 7)}$$

[Math 8]

$$\pi(R^2-r^2) \quad \text{(Expression 8)}$$

FIG. 3 shows the geometrical moment of inertia, the radius of gyration, and the sectional area of each of the hollow semicircular sectional shape and the hollow circular sectional shape calculated using Expressions 3 to 8. In FIG. 3, R=2 mm, r=1.8 mm, and t=0.2 mm are used for calculation.

Next, using the calculated value in FIG. 3, changes in resonance frequencies and in rigidity are examined which is resulted from the change of the sectional shape from hollow semicircular to hollow circular.

From Expression 1, it can be seen that in the case where the lengths of the bars and material constants are the same, change in resonance frequencies according to the change of the sectional shape is proportional to the radius of gyration. Moreover, the rigidness of the bar (flexural rigidity) is expressed as the product of Young's modulus of the material of the bar, and the geometrical moment of inertia. That is, the rigidness of the bar is proportional to the geometrical moment of inertia.

Thus, as a result of the change of the sectional shape from hollow semicircular to hollow circular, the radius of gyration increases approximately 1.9 times and the geometrical moment of inertia increases approximately 7.2 times. As a result, it can be seen that the resonance frequencies are raised approximately 1.9 times and the rigidness increases approximately 7.2 times.

Figure 4:
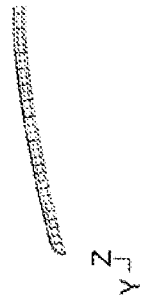
FIG. 4 is a table showing results of an analysis of resonance frequencies in eigen vibration modes using FEM, in the cases where real shape models of the diaphragm according to Embodiment 1 and the conventional diaphragm are implemented.
Figure 4:
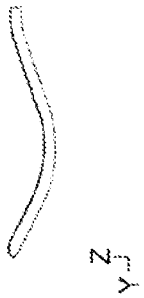
Figure 4:
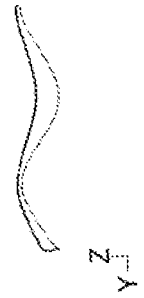
Figure 4:
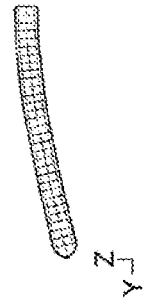
Figure 4:
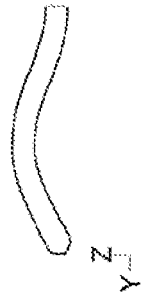
Figure 4:
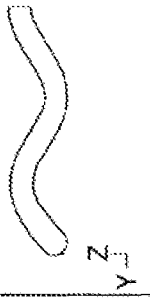

Next, in view of the theory as stated above, FIG. 4 shows the result of an analysis of the resonance frequencies in the eigen vibration mode using Finite Element Method (FEM) in which the real shape models are implemented of the diaphragm 100 described in this embodiment and of the diaphragm 1 described in the Background Art section. In FIG. 4, the resonance frequencies (theoretical values) are the result of calculations using Expression 1.

From FIG. 4, it can be seen that the theoretical values and the simulation analytic values well match. Moreover, it can be seen that the resonance frequencies of the diaphragm 100 the sectional shape of which is hollow circular are approximately twice as high as the resonance frequencies of the diaphragm 1 the sectional shape of which is hollow semicircular. From the change in the resonance frequencies in the simulation result, the change in rigidness resulted from the change of the sectional shape of the diaphragm from hollow semicircular to hollow circular is back calculated.

From Expression 1, the resonance frequency is proportional to the radius of gyration. Since the radius of gyration is the square root of the quotient of the geometrical moment of inertia and the sectional area, the geometrical moment of inertia is proportional to the product of the square of the radius of gyration and the sectional area. Thus, as seen from FIG. 4, the change in the sectional shapes from semicircular to circular increases the radius of gyration and the sectional area approximately twice as much. As a result, the rigidness increases approximately 8 times.

As described above, according to this embodiment, the rigidness of the diaphragm 100 in the long direction and the resonance frequencies in the mode can be raised. Thus, the number of resonance frequencies which influence the important voice band can be decreased.

It is to be noted that although the diaphragm 100 the sectional shape in the short direction of which is semicircular has been described in Embodiment 1, an oval sectional shape can further increase the rigidness. The sectional shape may be hollow trapezoidal or hollow polyhedral. That is, the sectional shape in the short direction of the diaphragm according to this embodiment is not specifically limited as long as the diaphragm is cylindrical and both ends of which in the long direction are closed. Moreover, although the both ends of the diagram 100 bulge out in the long direction in the example of the diaphragm 100 according to Embodiment 1, the present invention is not limited to this. The both end surfaces of the diaphragm in the long direction may have flat or other shapes.

Embodiment 2

Hereinafter, in Embodiment 2 of the present invention, an optimal driving method of the diaphragm 100 according to Embodiment 1 will be described with reference to the drawings. It is to be noted that descriptions of features shared in Embodiments 1 and 2 will be omitted and the difference between Embodiments 1 and 2 will mainly be described.

Figure 5A:
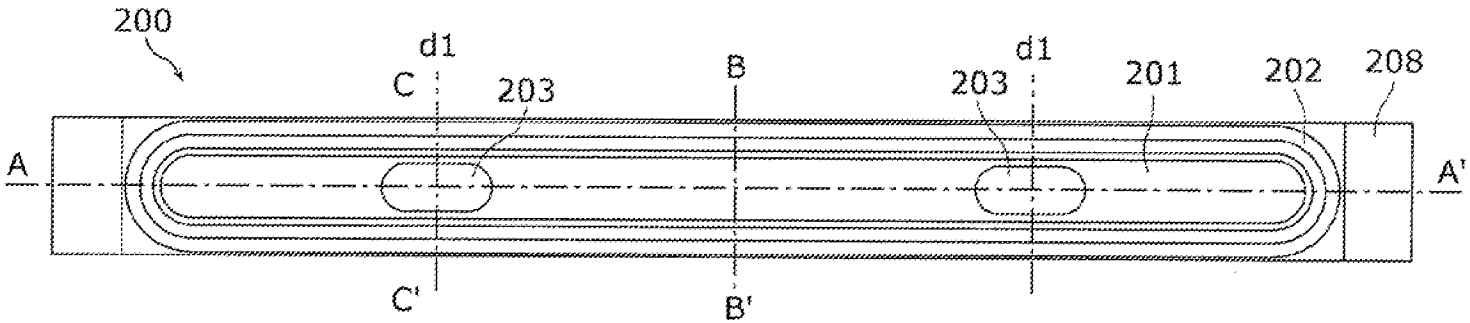
FIG. 5A is a top view of a speaker according to Embodiment 2.
Figure 5B:
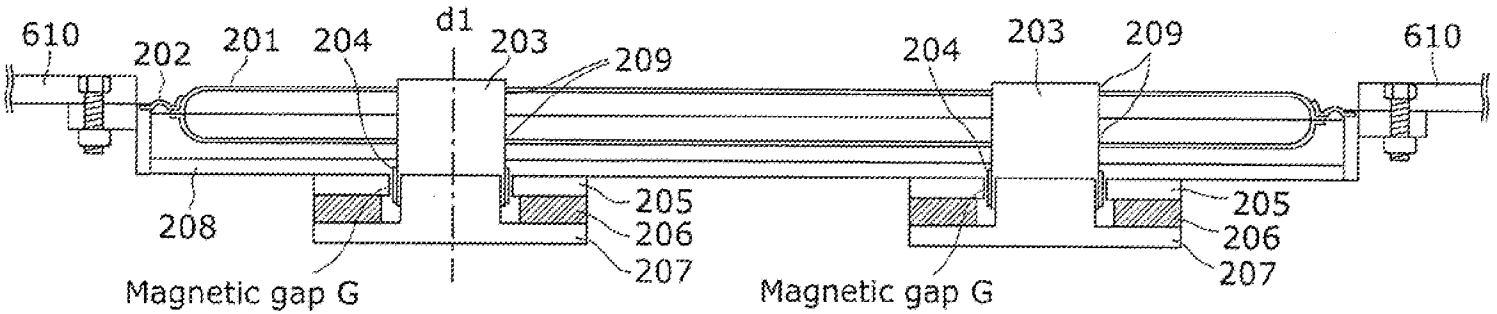
FIG. 5B is a sectional view of the speaker according to Embodiment 2 seen from A-A'.
Figure 5C:
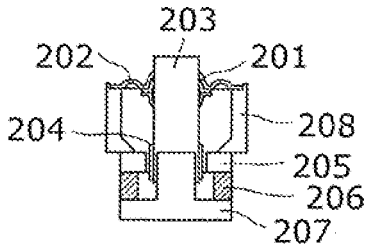
FIG. 5C is a sectional view of the speaker according to Embodiment 2 seen from B-B'.
Figure 5D:
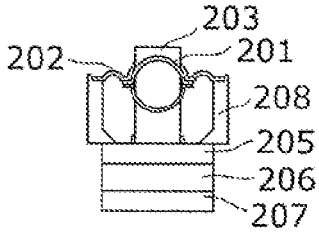
FIG. 5D is a sectional view of the speaker according to Embodiment 2 seen from C-C'.

FIG. 5A shows the top view of a speaker 200 according to this Embodiment, FIG. 5B shows a sectional view seen from A-A' in FIG. 5A, FIG. 5C shows a sectional view seen from B-B' in FIG. 5A, and FIG. 5D shows a sectional view seen from C-C' in FIG. A.

The speaker 200 according to this embodiment includes a diaphragm 201, an edge 202, voice coil bobbins 203, voice coils 204, plates 205, magnets 206, yokes 207, and a flame 208. It is to be noted that the diaphragm 201 has approximately the same structure as the diaphragm 100, however, differs in that through holes 209 which penetrate the diaphragm 201 in the vibrating direction and through which the voice coil bobbins 203 are inserted are formed at two positions.

The outer periphery of the edge 202 is fixed to the frame 208. Moreover, the sectional shape of the edge 202 is hollow semicircular. Furthermore, the edge 202 is desirably made from rubber material such as elastomer and SBR for the purpose of lowering a lower band limit despite the speaker 200 which is thin type. With respect to assembly of the edge 202 and the diaphragm 201, for example, each of them may be formed separately and then stuck together, or they may be entirely formed by insert molding and others.

Each voice coil bobbin 203 is inserted into a corresponding through hole 209 of the diaphragm 201 and is adhered to the inner surface of the through hole 209 to apply power to the diaphragm 201. The planer shape of the voice coil bobbin 203 viewed from the vibrating direction is semicircular or oval in the end of the long direction and is truck-shaped as a whole. The voice coil bobbin 203 is made from, for example, paper, aluminum, or a polymer resin film such as polyimide, and is formed in a desired shape.

Each voice coil 204 is wound around the voice coil bobbin 203 and held by the diaphragm 201 so as to be positioned in a magnetic gap G in a magnetic circuit. The planer shape of the voice coil bobbin 204 viewed from the vibrating direction is semicircular or oval in the end of the long direction and is truck-shaped as a whole. The voice coil bobbins 203 to which the voice coils 204 are fixed are disposed at two positions symmetric with respect to the center of the speaker 200 in the long direction. The voice coil 204 is a wound conductive wire made of copper, aluminum, and others.

The plates 205, the magnets 206, and the yokes 207 constitute external magnet type magnetic circuits. Each external magnet type magnetic circuit generates magnetic flux in the magnetic gap G formed between internal walls of a corresponding plate 5 and a corresponding yoke 7. As for the configuration of the magnetic circuit, the plate 205 is fixed on the top surface of a corresponding magnet 206, and the magnet 206 is fixed on the inner bottom surface of the yoke 207.

The external magnet type magnetic circuit is fixed to the frame 208. The external magnet type magnetic circuits and the voice coil bobbins 203 to which the voice coils 204 are fixed are disposed at two positions symmetric with respect to the center of the speaker 200 in the long direction such that the centers viewed from the vibrating direction match. The magnet 206 is made of rare-earth magnet such as ferrite magnet and neodymium magnet, samarium ferrous bond magnet, and others according to a targeted sound pressure and a shape.

Figure 15A:
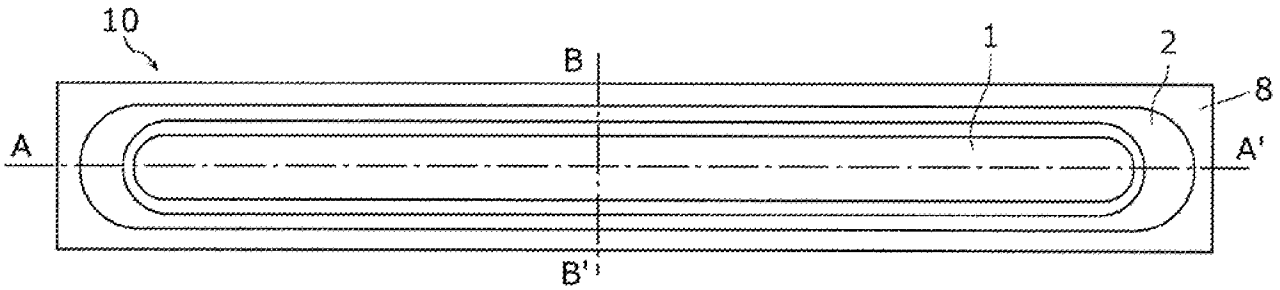
FIG. 15A is a top view of a conventional speaker.
Figure 15B:
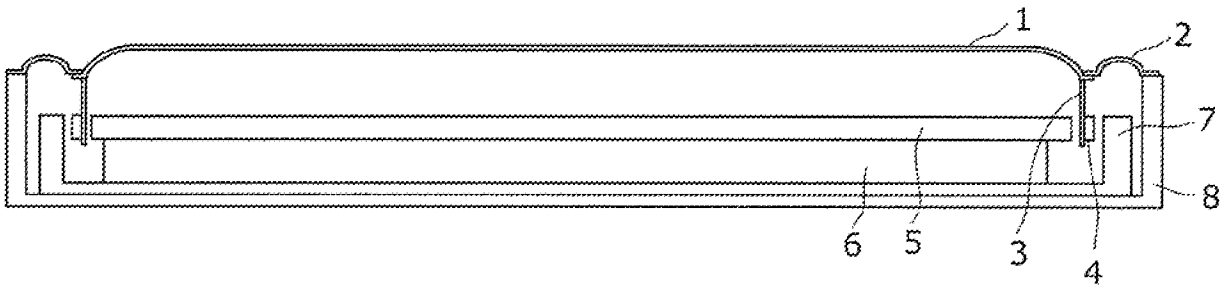
FIG. 15B is a sectional view of the conventional speaker seen from A-A'.
Figure 15C:
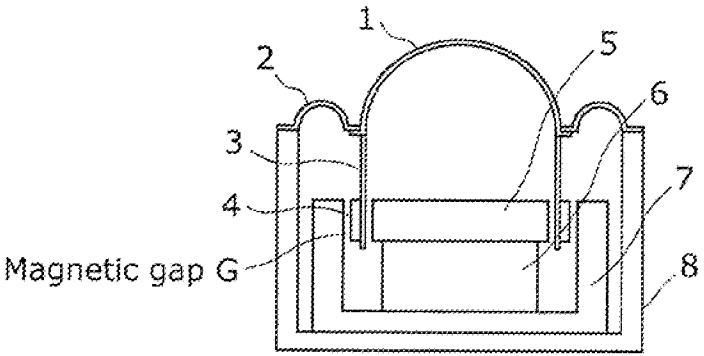
FIG. 15C is a sectional view of the conventional speaker seen from B-B'.

It is to be noted that the speaker 200 structured as described above is, for example, installed in a flat-screen television 600. As shown in FIG. 15, the television 600 is extremely thin, and the width of the housing around the display in which the speaker 200 is installed is extremely small. In this regard, the speaker 200 according to this embodiment is suited to be installed in such a place. This also applies to the other embodiments below.

The frame 208 of the speaker 200 according to this embodiment is fastened to a frame 610 of the television 600 as shown in FIG. 5B. It should be noted that the fastening method for the frame 208 and the frame 610 is not limited to this, but methods such as adhering may be employed.

The following describes the positions of driving points of the diaphragm 201.

The speaker according to Embodiment 1 has a driving point at the center of the diaphragm 100, and is driven by one voice coil (not shown). When resonance of the diaphragm 100 does not occur in the frequency band being used, this structure is sufficient. However, in the long and thin diaphragm 100 as described above, resonance occurs in low frequencies and the sound pressure frequency characteristics are disturbed. Therefore, in Embodiment 1, the structure for increasing rigidity of the diaphragm 100 ensures the bandwidth. However, in order to further flatten the sound pressure frequency characteristics, suppression of a resonance mode to occur is required.

In this regard, in Embodiment 2, the primary resonance mode that occurs at first is suppressed, and flat characteristics are maintained until the subsequent secondary resonance mode. For that purpose, the voice cons 204 are symmetrically disposed at two positions in the both sides that are d1 away from the center. That is, the driving points for controlling the primary resonance mode are provided so as to include node positions of the primary resonance mode.

The resonance form of the diaphragm 201 is approximately the same as the resonance form on the bar the both ends of which are free in the case where the diaphragm 201 is highly rigid compared to the edge 202 and the edge 202 has as small quantity as the diaphragm 201. Therefore, the node positions of the first resonance mode of the diaphragm 201 in the long direction is, given that the first end of the diaphragm in the long direction is 0 and the second end is 1, positions corresponding to 0.224 and 0.776 from the first end of the diaphragm in the long direction. Accordingly, the voice coil bobbins 203 are fixed at the node positions of the primary resonance mode of the diaphragm 201 in the long direction, that is, the positions corresponding to 0.224 and 0.776 from the first end of the diaphragm in the long direction.

It should be noted that the voice coil bobbins 203 are most desirably attached in such a manner that the node positions of the primary resonance mode (that is the positions corresponding to 0.224 and 0.776) match the centers (the centers of balance) of the voice coil bobbins 203. However, these need not perfectly match, and when the node positions of the primary resonance mode are included inside the external frame (the track shape in FIG. 5A) of the top surface of the voice coil bobbins 203, advantageous effects of this embodiment can be expected. This also applies to the other embodiments below.

The following describes operations of the speaker 200 having the above structure.

When current is supplied to the voice coil 204, the supplied current and a magnetic field generated in the magnetic gap G generate driving force in the voice coil 204. The generated driving force is transmitted to the diaphragm 201 through the voice coil bobbin 203. The generated driving force causes the diaphragm 201, the voice coil bobbin 203, and the voice coil 204 to perform the same vibratory movement. The vibration of the diaphragm 201 radiates sound to space.

As seen from FIG. 4, the number of resonance modes which affect on the important voice band in the diaphragm 100 is two. In this embodiment, since the diaphragm 201 is driven at the node positions of the primary resonance mode among these resonance modes, the primary resonance mode is suppressed, and flat reproduction is possible until the subsequent secondary resonance mode.

Figure 6A:
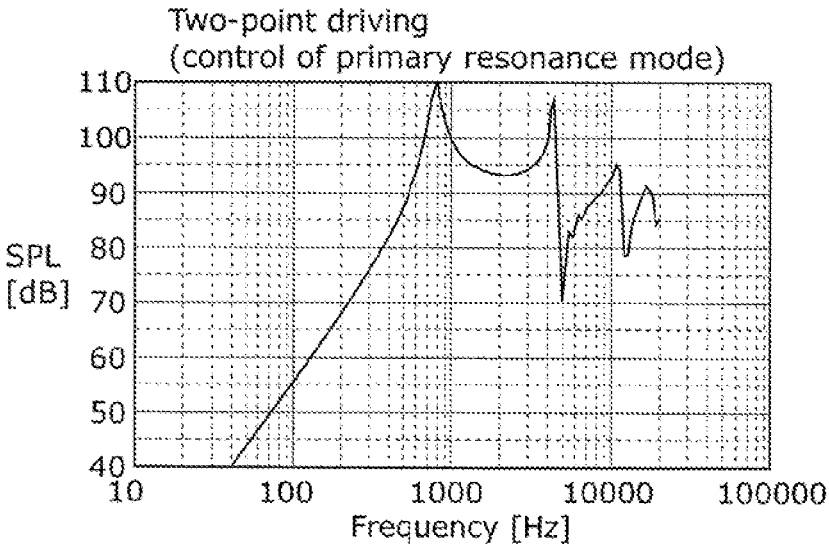
FIG. 6A is a diagram showing characteristics in the case of two-point driving which controls the primary resonance mode.

FIG. 6A shows speaker characteristics in this embodiment calculated using FEM analysis. In FIG. 6A, the vertical axis indicates SPL and the horizontal axis indicates frequencies. The speaker 200 according to this embodiment is capable of reproduction from Fo (800 Hz) to 4.5 kHz. The frequencies in FIG. 6A are lower than the resonance frequencies in FIG. 4 because the resonance frequencies are lowered by the edge 202 and by added mass of the voice coil 204.

It should be noted that, for ensuring further bandwidth, it is desirable to suppress the secondary resonance mode, too.

Embodiment 3

The following describes Embodiment 3 of the present invention with reference to the drawings. It should be noted that detailed description of the features shared with Embodiments 1 and 2 are omitted, and differences are mainly described.

Figure 7A:
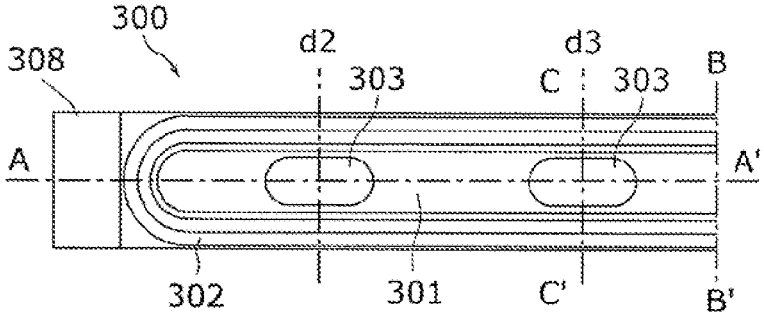
FIG. 7A is a top view of a speaker according to Embodiment 3.
Figure 7B:
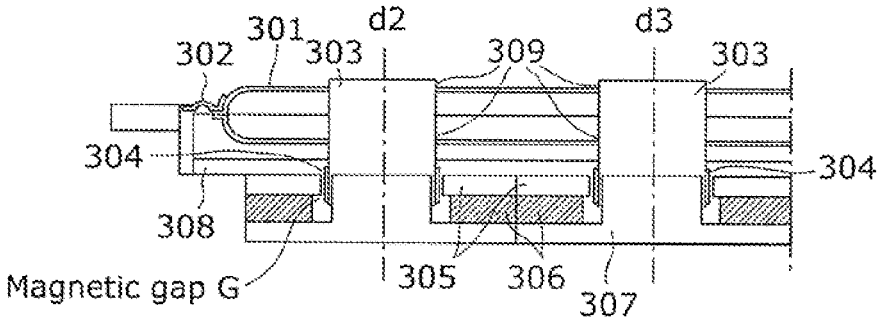
FIG. 7B is a sectional view of the speaker according to Embodiment 3 seen from A-A'.
Figure 7C:
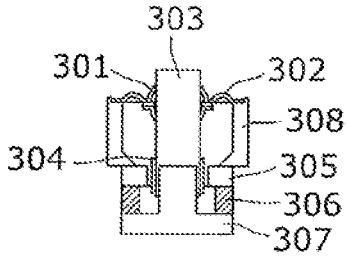
FIG. 7C is a sectional view of the speaker according to Embodiment 3 seen from B-B'.
Figure 7D:
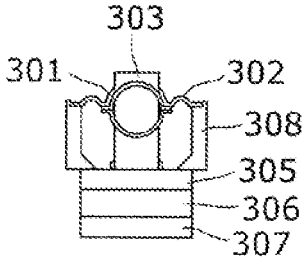
FIG. 7D is a sectional view of the speaker according to Embodiment 3 seen from C-C'.

FIG. 7A shows the top view of a speaker 300 according to this Embodiment, FIG. 7B shows a sectional view seen from A-A' in FIG. 7A, FIG. 7C shows a sectional view seen from B-B' in FIG. 7A, and FIG. 70 shows a sectional view seen from C-C' in FIG. 7A. It should be noted that since the speaker 300 is symmetrically shaped, only the left half from the center line is shown in FIGS. 7A and 7B.

The speaker 300 according to this embodiment includes a diaphragm 301, an edge 302, voice coil bobbins 303, voice coils 304, plates 305, magnets 306, yokes 307, and a flame 308. The diaphragm 301 has approximately the same structure as the diaphragm 100, however, differs in that through holes 309 which penetrate the diaphragm 301 in the vibrating direction and through which the voice coil bobbins 303 are inserted are formed at four positions (only two positions are shown).

The outer periphery of the edge 302 is fixed to the frame 308. Moreover, the sectional shape of the edge 302 is hollow semicircular. Furthermore, the edge 302 is desirably made from rubber material such as elastomer and SBR for the purpose of lowering a lower band limit despite the speaker 300 which is thin type. With respect to assembly of the edge 302 and the diaphragm 301, each of them may be formed separately and then stuck together, or they may be entirely formed by insert molding and others.

Each voice coil bobbin 303 is inserted into a corresponding through hole 309 of the diaphragm 301 and is attached to the inner surface of the through hole 309 to apply power to the diaphragm 301. The planer shape of the voice coil bobbin 303 viewed from the vibrating direction is semicircular or oval in the end of the long direction and is truck-shaped as a whole. The voice coil bobbin 303 is made from, for example, paper, aluminum, or a polymer resin film such as polyimide, and is formed in a desired shape.

Two pairs of the voice coil bobbins 303 are disposed at four positions in total symmetrically with respect to the center of the diaphragm 301 in the long direction.

Driving positions d2 and d3 of the diaphragm 301 and the voice coil bobbins 303 are, as described below, the positions to control both the primary resonance mode and the secondary resonance mode. Before a description of the driving points for controlling the both, driving points (node points) for controlling the secondary resonance mode are described.

The node positions of the secondary resonance mode is, given that the first end of the diaphragm 301 in the long direction is 0 and the second end is 1, positions corresponding to 0.0944, 0.3558, 0.6442, and 0.9056 from the first end of the diaphragm 301 in the long direction. However, in controlling the secondary resonance mode, there is no need to drive all of the above four points, but it is sufficient to drive two points symmetric with respect to the center of the diaphragm 301 in the long direction. That is, it is sufficient that the voice coil bobbins 303 are fixed at positions corresponding to 0.0944 and 0.9056 from the first end of the diaphragm 301 in the long direction, or at positions corresponding to 0.3558 and 0.6442 from the first end of the diaphragm 301 in the long direction.

Figure 6B:
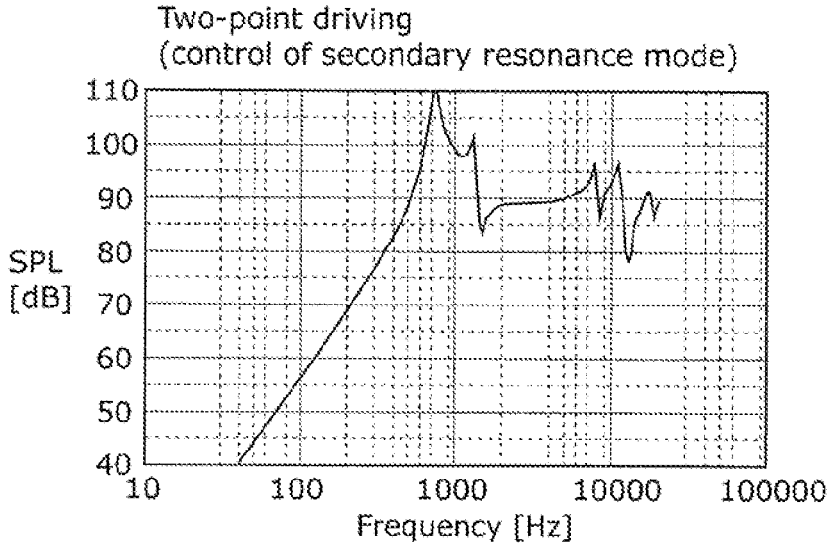
FIG. 6B is a diagram showing characteristics in the case of two-point driving which controls the secondary resonance mode.

In this case, the sound pressure frequency characteristics are calculated as shown in FIG. 6. With reference to FIG. 6B, although the secondary resonance mode is controlled, the primary resonance mode exists in 1.2 kHz, which is lower than the secondary resonance mode. Therefore, a reproduction bandwidth becomes narrow. Thus, in this embodiment, driving points are provided at positions for controlling both the primary resonance mode and the secondary resonance mode.

Individual canceling of each resonance mode is achieved by driving the diaphragm 301 at the node positions. However, in order to control both the primary resonance mode and the secondary resonance mode, driving at special four points is required. The driving points are determined as described below.

In the resonance form of the bar the both ends of which are free, a forced vibration displacement ξ caused by intensive driving force Fx*ejωt can be obtained by Expression 9.

[Math 9]

$$\xi = \frac{F_x}{\rho s l} \sum_m \frac{1}{\omega_m^2 - \omega^2} \cdot \Xi_m(x) \cdot \Xi_m(y) \cdot e^{j\omega t} \qquad \text{(Expression 9)}$$

Where ρ denotes density, s denotes a sectional area of the bar, l denotes the length of the bar, Ξm(x) and Ξm(y) denote criterion functions expressing a vibration form, and ω denotes angular velocity.

Next, given that the length of the diaphragm 301 in the long direction is 1, a vibration displacement in the case where four points of x1, x2, x3, and x4 from the first end in the long direction is driven is obtained by Expression 10.

[Math 10]

$$\xi = \frac{1}{\rho s l} \sum_m \frac{1}{\omega_m^2 - \omega^2} \cdot \{F_{x1}\Xi_m(x1) + F_{x2}\Xi_m(x2) + F_{x3}\Xi_m(x3) + F_{x4}\Xi_m(x4)\} \cdot \Xi_m(y) \cdot e^{j\omega t} \quad \text{(Expression 10)}$$

At this time, a condition in which neither the primary resonance mode nor the secondary resonance mode is generated is that x1, x2, x3, and x4 satisfy Expression 11. That is, the driving points for controlling both the primary resonance mode and the secondary resonance mode are obtained by determining x1, x2, x3, and x4 which satisfy Expression 11. It should be noted that since the driving positions are symmetric with respect to the center, an asymmetry mode is not generated. Therefore, here, the resonance modes are referred to as the primary resonance mode and the secondary resonance mode sequentially from lower mode except the asymmetry mode.

[Math 11]

$$\{F_{x1}\Xi_m(x1)+F_{x2}\Xi_m(x2)+F_{x3}\Xi_m(x3)+F_{x4}\Xi_m(x4)\}=0 \quad \text{(Expression 11)}$$

Here, since the diaphragm 310 is driven symmetrically with respect to the center using the same amount of power, Expression 12 below holds.

[Math 12]

$$F_{x1}=F_{x2}=F_{x3}=F_{x4} \quad \text{(Expression 12)}$$

Thus, a condition to satisfy Expression 11 can be expressed as Expression 13.

[Math 13]

$$\begin{cases} \Xi_1(x1) + \Xi_1(x2) + \Xi_1(1-x2) + \Xi_1(1-x1) = 0 \\ \Xi_2(x1) + \Xi_2(x2) + \Xi_2(1-x2) + \Xi_2(1-x1) = 0 \end{cases} \quad \text{(Expression 13)}$$

Driving points x for simultaneously satisfying Expression 13 are determined as Expressions 14 to 17 below.

$$x1=0.1130 \quad \text{(Expression 14)}$$

$$x2=0.37775 \quad \text{(Expression 15)}$$

$$x3=(1-x2)=0.62225 \quad \text{(Expression 16)}$$

$$x4=(1-x1)=0.8770 \quad \text{(Expression 17)}$$

Accordingly, four points indicated by x1 to x4 which satisfy Expressions 14 to 17 are determined to be the driving points.

Figure 6C:
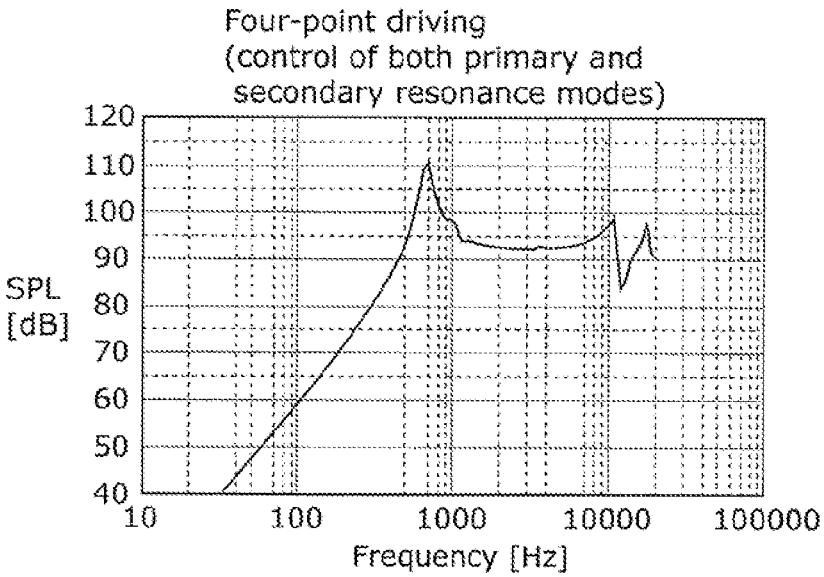
FIG. 6C is a diagram showing characteristics in the case of four-point driving which controls both the primary and the secondary resonance modes.

FIG. 6C shows the result of a FEM simulation analysis of speaker characteristics according to this embodiment. In FIG. 6C, it can be seen that both the primary resonance mode and the secondary resonance mode are decreased. According to this embodiment, both the primary resonance mode and the secondary resonance mode are suppressed, and the speaker 300 which enables reproduction in a wideband of 10 kHz or more can be provided.

Embodiment 4

As seen from the above result, use of four-point driving which controls both the primary resonance mode and the secondary resonance mode is the best. However, use of four voice coils requires four magnetic circuits, resulting in increase in material costs for the magnet. Therefore, there is a need for limiting the number of voice coils to be used to two, and specifying driving positions in which deviation range of peak/dip caused by both resonance modes can be suppressed to the same extent so as to be the minimum. A speaker 400 according to this embodiment appropriately suppresses both the primary resonance and the secondary resonance while using two driving points, and aims at reproduction in a wideband.

The following describes the speaker 400 according to Embodiment 4 with reference to the drawings. It should be noted that detailed descriptions of the features shared with Embodiments 1 to 3 are omitted, and differences are mainly described.

Figure 8A:
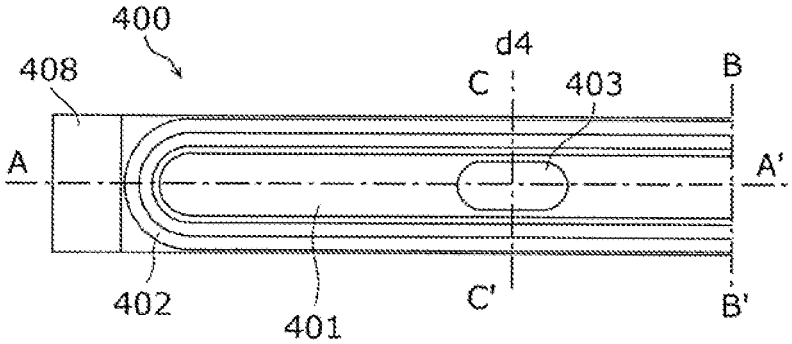
FIG. 8A is a top view of a speaker according to Embodiment 4.
Figure 8B:
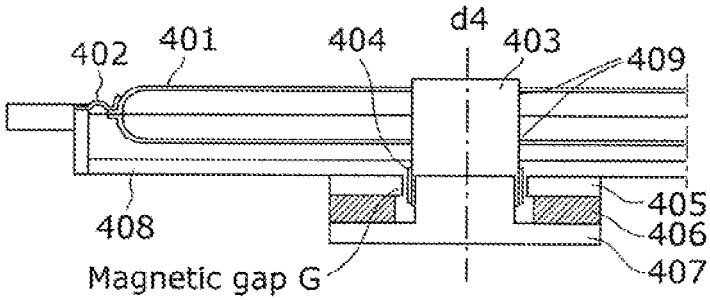
FIG. 8B is a sectional view of the speaker according to Embodiment 4 seen from A-A'.
Figure 8C:
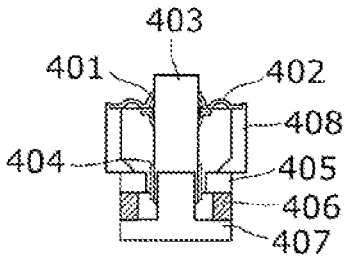
FIG. 8C is a sectional view of the speaker according to Embodiment 4 seen from B-B'.
Figure 8D:
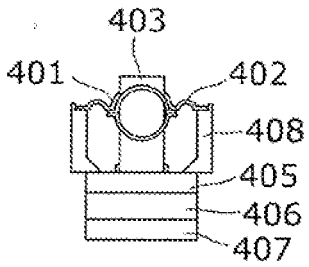
FIG. 8D is a sectional view of the speaker according to Embodiment 4 seen from C-C'.

FIG. 8A shows the top view of the speaker 400 according to this embodiment, FIG. 8B shows a sectional view seen from A-A' in FIG. 8A, FIG. 8C shows a sectional view seen from B-B' in FIG. 8A, and FIG. 8D shows a sectional view seen from C-C in FIG. 8A. It should be noted that since the speaker 400 is symmetrically shaped, only the left half from the center line is shown in FIGS. 8A and 8B. The speaker 400 according to this embodiment has a basic structure equivalent to that in Embodiment 2, but a driving point d4 of a voice coil 404 is different from that in Embodiment 2.

The speaker 400 according to this embodiment includes a diaphragm 401, an edge 402, voice coil bobbins 404, voice coils 404, plates 405, magnets 406, yokes 408, and a flame 408 as shown in FIGS. 8A to 8D. The diaphragm 401 has approximately the same structure as the diaphragm 100, however, differs in that through holes 409 which penetrate the diaphragm 401 in the vibrating direction and through which the voice coil bobbins 403 are inserted are formed at two positions.

The driving point d4 is placed at the positions to appropriately control both the primary resonance mode and the secondary resonance mode of the diaphragm 401 in the long direction. The positions are intermediate points or near the intermediate points (given that the length of the diaphragm in the long direction is 1, the positions are at 0.29 and 0.71) between node positions of the primary resonance mode of the diaphragm 401 (given that the length of the diaphragm in the long direction is 1, the positions are at 0.224 and 0.776) and the center-side node positions of the secondary resonance mode (given that the length of the diaphragm in the long direction is 1, the positions are at 0.355 and 0.645).

The following describes examined matters about the driving points.

Figure 9A:
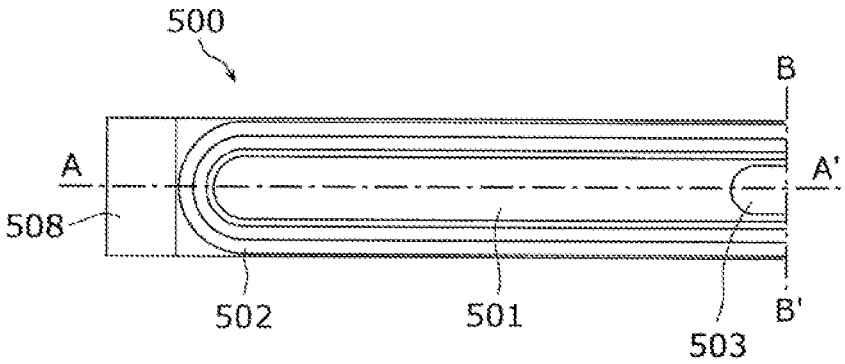
FIG. 9A is a top view of a speaker used for a simulation in which driving positions are varied.
Figure 9B:
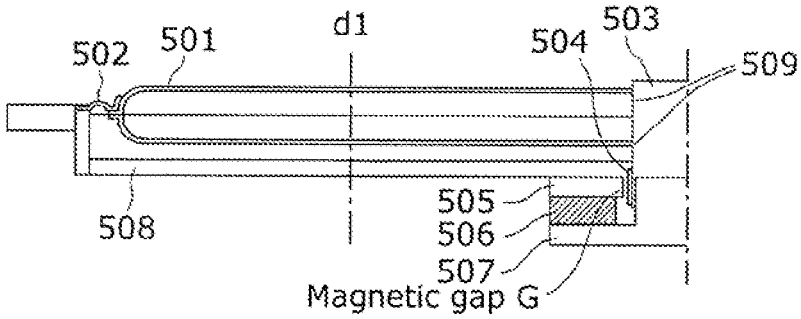
FIG. 9B is a sectional view of the speaker in FIG. 9A seen from A-A'.
Figure 9C:
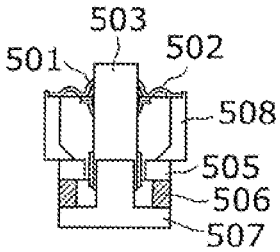
FIG. 9C is a sectional view of the speaker in FIG. 9A seen from B-B'.

Assuming a speaker 500 the driving point of which is at the center as shown in FIGS. 9A to 9C, the sound pressure frequency characteristics are analyzed through simulation. The speaker 500 shown in FIGS. 9A to 9C includes a diaphragm 501, an edge 502, a voice coil bobbin 503, a voice coil 504, a plate 505, a magnet 506, a yoke 508, and a flame 508. In an example shown in FIGS. 9A to 9C, the voice coil bobbin 503 is attached at the center of the diaphragm 501 in the long direction.

Figure 10:
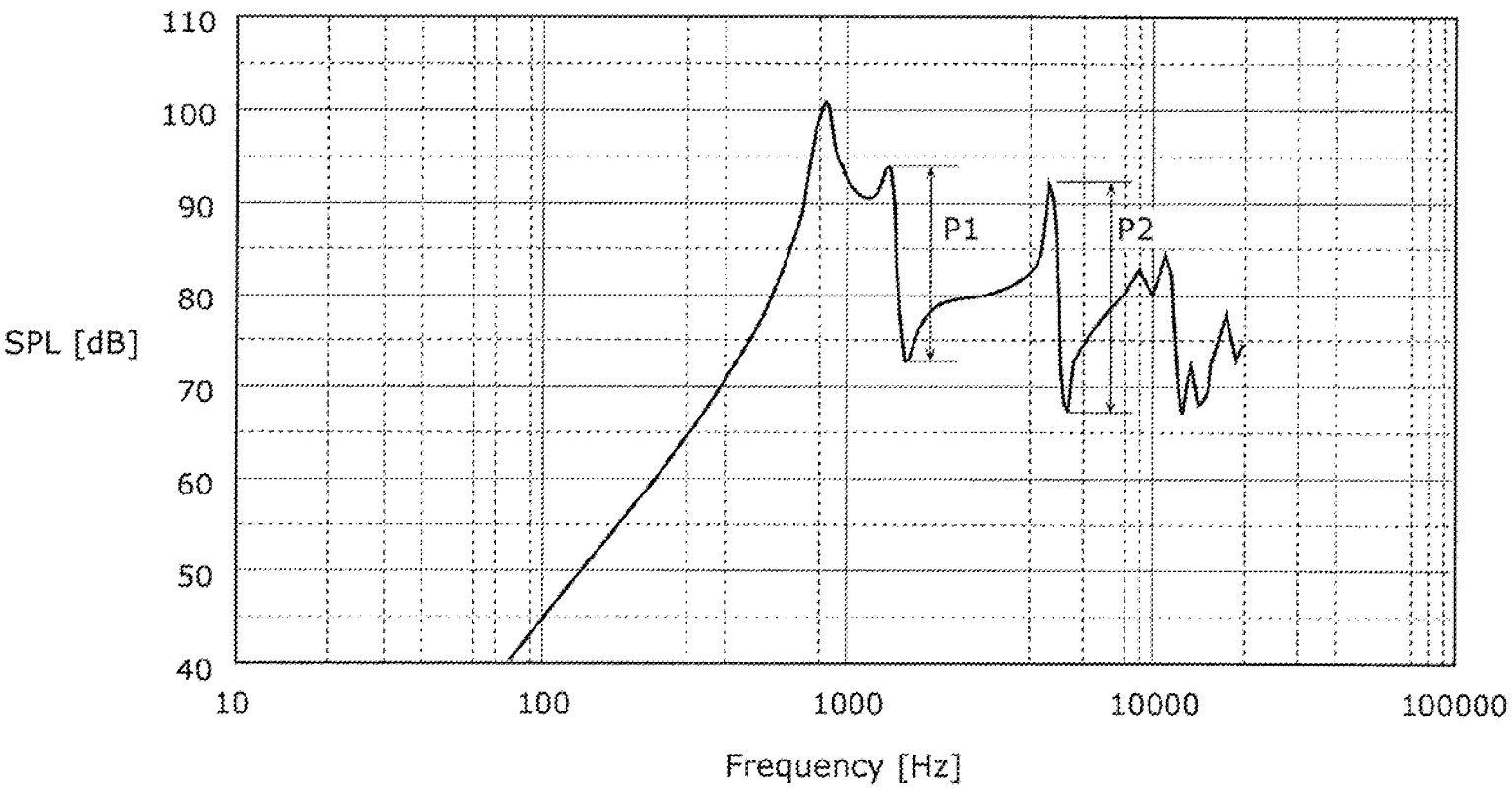
FIG. 10 is a diagram showing peak dip in a resonance mode having sound pressure frequency characteristics determined by the simulation.

FIG. 10 shows the result of the simulation analysis. P1 and P2 shows deviations of peak/dip that occur on the sound pressure frequency characteristics caused by the primary resonance mode and the secondary resonance mode in the long direction. The sound pressure frequency characteristics are analyzed through simulation in which the voice coil bobbin 503 is moved from the center of the diaphragm 501 toward an end of the diaphragm 501 in the long direction so that the sound pressure deviations P1 and P2 at various positions are determined. That is, the sound pressure frequency characteristics are analyzed through simulation with respect to changes in driving positions.

Figure 11:
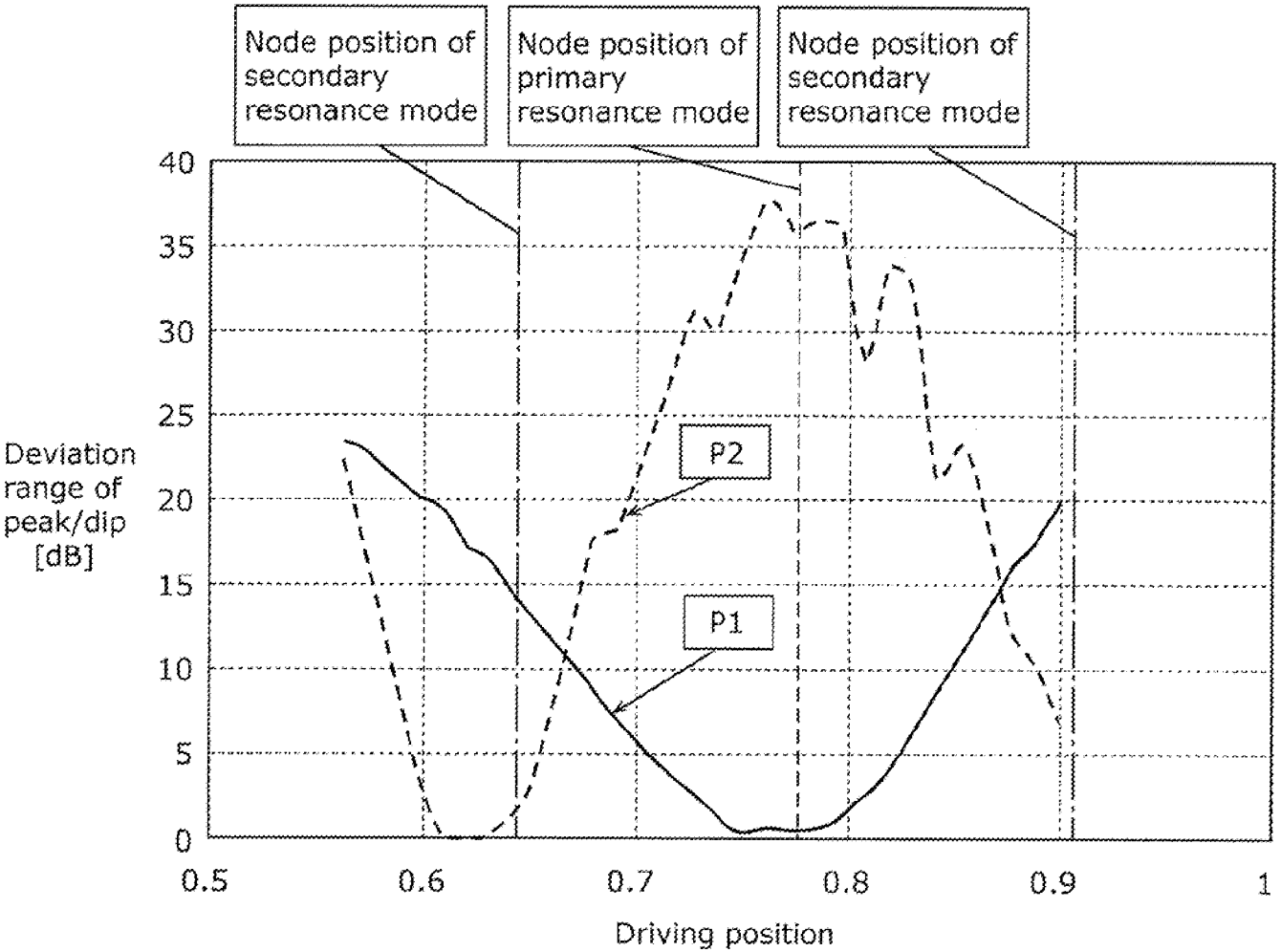
FIG. 11 is a diagram showing a deviation range of the peak/dip caused by the vibration modes with respect to the driving positions.

FIG. 11 shows a deviation range of the peak/dip caused by the resonance mode with respect to the driving positions. In FIG. 11, the horizontal axis indicates proportion of the distance from the first end in the long direction to the length of the entire diaphragm 401 in the long direction, given that the length of the entire diaphragm 401 in the long direction is 1. The numeral 0.5 at the center of the graph indicates the central position of the diaphragm 401 in the long direction. Moreover, the solid line in the graph shows the deviation range P1 of the peak/dip caused by the influence of the primary resonance mode, and the dotted line shows the deviation range P2 of the peak/dip caused by the influence of the secondary resonance mode. Moreover, the vertical lines in FIG. 11 indicates the node positions of the primary and the secondary resonance modes calculated from the resonance form of the bar both ends of which are free.

From FIG. 11, it can be seen that the driving positions to minimize the deviation range are slightly off but near the node positions in the primary resonance mode and the secondary resonance mode calculated from the resonance form of the bar both ends of which are free. From the graph, it can be seen that the position to suppress the primary resonance mode is 0.760 and the position to suppress the secondary resonance mode is 0.620.

Moreover, from FIG. 7, it can be seen that both deviation ranges of the peak/dip caused by the both resonance modes can be decreased to the same extent so as to be the minimum at the position of 0.668.

According to these results, the position where the both deviation ranges of the peak/dip caused by the both resonance modes can be decreased to the same extent so as to be the minimum is the position between the node position of the primary resonance mode and the inner node position of the secondary resonance mode. Given that the length of the diaphragm is 1, the position is at 0.668.

According to this embodiment as described above, driving diaphragm 401 between the node positions of the primary resonance mode and the inner node positions of the secondary resonance mode can decrease the deviation range of the peak/dip caused by the primary resonance mode and the secondary resonance mode to the same extent to the minimum.

Figure 12:
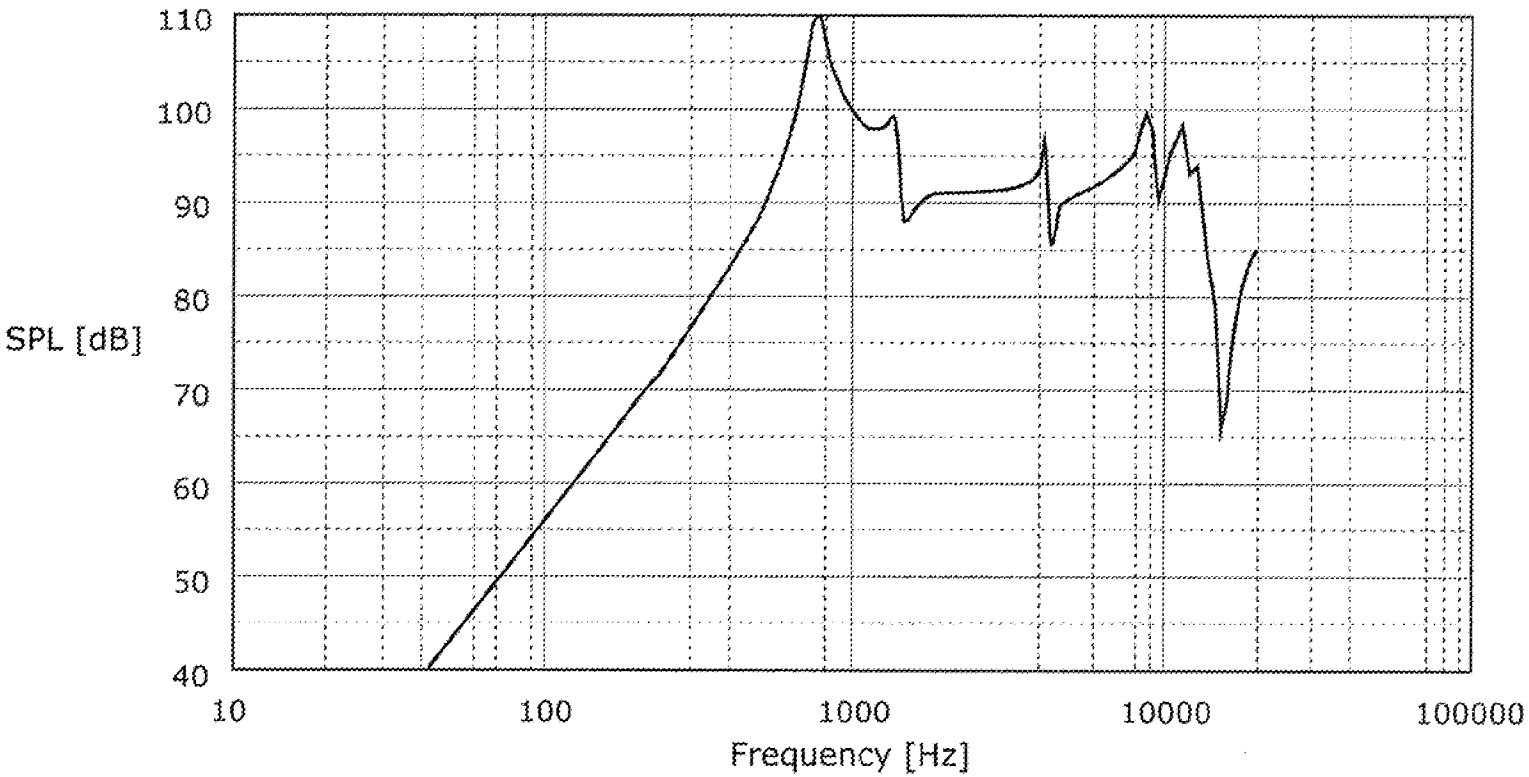
FIG. 12 is a diagram showing the result of a simulation analysis of the sound pressure frequency characteristics in the case where the diaphragm is driven at positions for suppressing the primary resonance mode and the secondary resonance mode.

FIG. 12 shows the result of the simulation analysis of the sound pressure frequency characteristics in the case where the diaphragm is driven at the above-described positions. As can be seen from FIG. 12, the deviation range of the peak/dip caused by the primary resonance mode and the deviation range of the peak/dip caused by the secondary resonance mode are decreased to the same extent so as to be the minimum, and the sound pressure frequency characteristics come close to be flat.

It should be noted that in the speaker 400 according to this embodiment, the voice coil bobbin 403 is fixed through the through hole 409 of the diaphragm 401, so that resonance which is generated in the case where the voice coil bobbin 403 is fixed to only the lower side of the diaphragm 501 can be controlled in a higher band at the upper part of the diaphragm 501. With this, an advantage is obtained that flatter sound pressure frequency characteristics can be realized.

Figure 13:
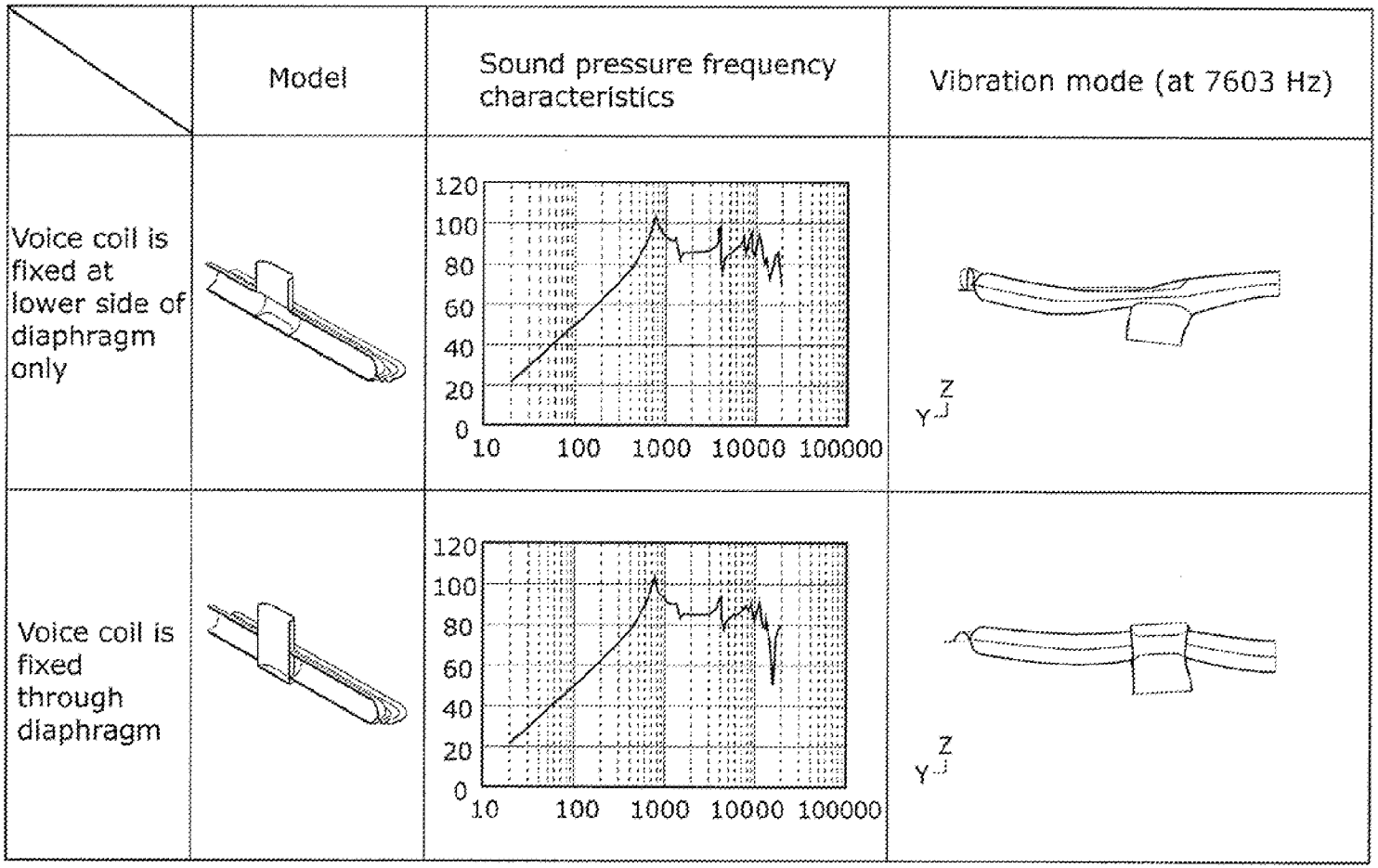
FIG. 13 is a diagram showing the difference in sound pressure frequency characteristics derived from difference of methods for fixing a voice coil bobbin 203 to a diaphragm 201.
Figure 14:
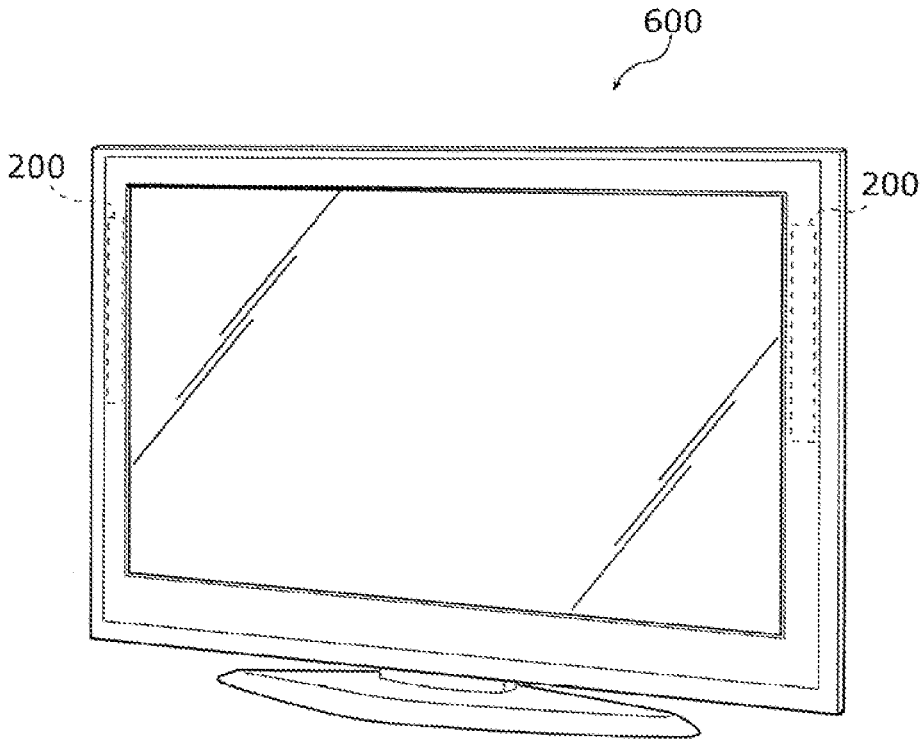
FIG. 14 is an outer view of a television having the speaker according to Embodiment 2 of the present invention therein.

FIG. 13 shows a difference in sound pressure frequency characteristics resulted from the difference in fixing conditions of the voice coil bobbin 403 to the diaphragm 401.

As can be seen from FIG. 13, a disturbance of the characteristics is found around 7.6 kHz in the case where the voice coil bobbin 403 is fixed only to the lower part of the diaphragm 401. This is because of the resonance generated at the upper part of the diaphragm 401. On the other hand, it can be seen that the disturbance of the characteristics around 7.6 kHz is improved in the case where the voice coil bobbin 403 is fixed to the diaphragm 401 such that the voice coil bobbin 403 is inserted through the diaphragm 401 in the vibrating direction.

Furthermore, since the speaker according to the embodiments of the present invention can easily be made smaller and thinner, its application is not limited to the flat-screen television 600 shown in FIG. 15, but it is also advantageous to be used in an electronic device such as a cellular phones and a PDA. That is, the electronic device includes the speaker according to the embodiments of the present invention and a housing holding the speaker therein.

Although the embodiments of the present invention have been described with reference to the drawings, the present invention is not limited to the embodiments shown in the drawings. It is possible to make various modifications and variations to the embodiments shown in the drawings within the range the same as or equivalent to the present invention.

INDUSTRIAL APPLICABILITY

The speaker including the diaphragms according to the present invention is useful as a speaker which is capable of controlling divided resonance despite having a long and thin structure.

REFERENCE SIGNS LIST

1, 100, 201, 301, 401, 501 diaphragm
2, 202, 302, 402, 502 edge
3, 203, 303, 403, 503 voice coil bobbin
4, 204, 304, 404, 504 voice coil
5, 205, 305, 405, 505 plate
6, 206, 306, 406, 506 magnet
7, 207, 307, 407, 507 yoke
8, 208, 308, 408, 508, 610 frame
10, 200, 300, 400, 500 speaker
100*a* the first diaphragm
100*b* the second diaphragm
102 diaphragm-bonding portion
209, 309, 409, 509 through hole
600 television

The invention claimed is:

1. A speaker comprising:

a diaphragm which is cylindrical and has closed ends;

an edge which supports the diaphragm in a manner which allows the diaphragm to vibrate in a vibrating direction;

a voice coil bobbin around which a voice coil is wound and which is connected to the diaphragm; and a magnetic circuit for driving the voice coil, wherein the diaphragm has a circular cross-sectional shape in a short direction, wherein the diaphragm is formed to include a first diaphragm and a second diaphragm, wherein the first diaphragm includes:

a first circular arc portion having a first semicircular cross-sectional shape in the short direction; and a first flange protruding outward from both ends of the first circular arc portion in a radial direction, wherein the second diaphragm includes:

a second circular arc portion having a second semicircular cross-sectional shape in the short direction; and a second flange protruding outward from both ends of the second circular arc portion in a radial direction, and wherein the first flange of the first diaphragm and the second flange of the second diaphragm are connected to each other.

2. The speaker according to claim 1, wherein both ends of the diaphragm have a semispherical shape which bulges outward in a long direction.

3. The speaker according to claim 1, wherein the voice coil bobbin includes two voice coil bobbins, and the two voice coil bobbins are attached at node positions of a primary resonance mode in the diaphragm symmetrically with respect to a center of the diaphragm in a long direction.

4. The speaker according to claim 3, wherein, given that a first end of the diaphragm in the long direction is 0 and a second end in the long direction is 1, an attachment position of a first voice coil bobbin of the two voice coil bobbins includes a position 0.224, and an attachment position of a second voice coil bobbin of the two voice coil bobbins includes a position 0.776.

5. The speaker according to claim 1, wherein the voice coil bobbin includes four voice coil bobbins, and the four voice coil bobbins are attached at node positions of a primary resonance mode and a secondary resonance mode in the diaphragm symmetrically with respect to a center of the diaphragm in a long direction.

6. The speaker according to claim 5, wherein, given that a first end of the diaphragm in the long direction is 0 and a second end in the long direction is 1, an attachment position of a first voice coil bobbin of the four voice coil bobbins includes a position 0.113, an attachment position of a second voice coil bobbin of the four voice coil bobbins includes a position 0.37775, an attachment position of a third voice coil bobbin of the four voice coil bobbins includes a position 0.62225, and an attachment position of a fourth voice coil bobbin of the four voice coil bobbins includes a position 0.877.

7. The speaker according to claim 1, wherein the diaphragm has a through hole at an attachment position of the voice coil bobbin, and the voice coil bobbin is attached to the diaphragm by inserting the voice coil bobbin through the through hole.

8. An electronic device which includes a speaker, wherein the speaker includes:

a diaphragm which is cylindrical and has closed ends;

an edge which supports the diaphragm in a manner which allows the diaphragm to vibrate in a vibrating direction;

a voice coil bobbin around which a voice coil is wound and which is connected to the diaphragm; and a magnetic circuit for driving the voice coil, wherein the diaphragm has a circular cross-sectional shape in a short direction, wherein the diaphragm is formed to include a first diaphragm and a second diaphragm, wherein the first diaphragm includes:

a first circular arc portion having a first semicircular cross-sectional shape in the short direction; and a first flange protruding outward from both ends of the first circular arc portion in a radial direction, wherein the second diaphragm includes:

a second circular arc portion having a second semicircular cross-sectional shape in the short direction; and a second flange protruding outward from both ends of the second circular arc portion in a radial direction, and wherein the first flange of the first diaphragm and the second flange of the second diaphragm are connected to each other.

9. A speaker comprising:

a diaphragm which is cylindrical and has closed ends;

an edge which supports the diaphragm in a manner which allows the diaphragm to vibrate;

a voice coil bobbin around which a voice coil is wound and which is connected to the diaphragm; and a magnetic circuit for driving the voice coil, wherein the voice coil bobbin includes two voice coil bobbins, wherein each of the two voice coil bobbins is attached between a corresponding one of node positions of a primary resonance mode and a corresponding one of node positions of a secondary resonance mode in the diaphragm, the two voice coil bobbins being symmetric with respect to a center of the diaphragm in a long direction, and given that a first end of the diaphragm in the long direction is 0 and a second end in the long direction is 1:

an attachment position of a first voice coil bobbin of the two voice coil bobbins includes a position 0.332; and an attachment position of a second voice coil bobbin of the two voice coil bobbins includes a position 0.668.

10. The speaker according to claim 9, wherein both ends of the diaphragm have a semispherical shape which bulges outward in the long direction.

11. The speaker according to claim 9, wherein the diaphragm has a through hole at an attachment position of the voice coil bobbin, and wherein the voice coil bobbin is attached to the diaphragm by inserting the voice coil bobbin through the through hole.

12. An electronic device which includes a speaker, wherein the speaker includes:

a diaphragm which is cylindrical and has closed ends;

an edge which supports the diaphragm in a manner which allows the diaphragm to vibrate;

a voice coil bobbin around which a voice coil is wound and which is connected to the diaphragm; and a magnetic circuit for driving the voice coil, wherein the voice coil bobbin includes two voice coil bobbins, wherein each of the two voice coil bobbins is attached between a corresponding one of node positions of a primary resonance mode and a corresponding one of node positions of a secondary resonance mode in the diaphragm, the two voice coil bobbins being symmetric with respect to a center of the diaphragm in a long direction, and given that a first end of the diaphragm in the long direction is 0 and a second end in the long direction is 1:

an attachment position of a first voice coil bobbin of the two voice coil bobbins includes a position 0.332; and an attachment position of a second voice coil bobbin of the two voice coil bobbins includes a position 0.668.

13. The speaker according to claim 1, wherein one of the first flange and the second flange is fixed to the edge.

14. The speaker according to claim 13, wherein the speaker further includes a frame fixed on a bottom surface of the magnetic circuit, and wherein an outer periphery of the edge is fixed to the frame.

15. The speaker according to claim 1, wherein the edge allows the diaphragm to vibrate in a single vibrating direction.

* * * * *